US006372112B1

(12) United States Patent
Ferronato

(10) Patent No.: US 6,372,112 B1
(45) Date of Patent: Apr. 16, 2002

(54) METHOD OF FORMING A HIGH PRECISION FLEXIBLE ABRASIVE MEMBER

(76) Inventor: Sandro Giovanni Giuseppe Ferronato, Noorderkerkstraat 19, NL-8081 ET Tilburg (NL)

( * ) Notice: Subject to any disclaimer, the term of this patent is extended or adjusted under 35 U.S.C. 154(b) by 0 days.

(21) Appl. No.: 09/367,595

(22) PCT Filed: Feb. 18, 1997

(86) PCT No.: PCT/NL97/00068

§ 371 Date: Dec. 3, 1999

§ 102(e) Date: Dec. 3, 1999

(87) PCT Pub. No.: WO98/35789

PCT Pub. Date: Aug. 20, 1998

(51) Int. Cl.[7] ..... C25D 1/00; C25D 15/00
(52) U.S. Cl. ..... 205/110; 205/67
(58) Field of Search ..... 205/67, 110

(56) References Cited

U.S. PATENT DOCUMENTS 4,863,573 A * 9/1989 Moore et al. ..... 204/16
4,874,478 A * 10/1989 Ishak et al. ..... 204/16
5,647,966 A * 7/1997 Uriu et al. ..... 205/78
5,755,946 A * 5/1998 Ferronato ..... 205/110

FOREIGN PATENT DOCUMENTS

| | | | |
|---|---|---|---|
| EP | 0 276 946 | | 8/1988 |
| EP | 0 546 732 | | 6/1993 |
| EP | WO 96/09139 A | * | 3/1996 |
| FR | 2 565 870 | | 12/1985 |
| FR | 2565870 A | * | 8/1988 |
| WO | WO 96/09139 | | 3/1996 |

* cited by examiner

*Primary Examiner*—Donald R. Valentine
*Assistant Examiner*—Erica Smith-Hicks
(74) *Attorney, Agent, or Firm*—Young & Thompson

(57) ABSTRACT

A method of manufacturing a flexible abrasive member, includes the steps of providing a porous substrate, impregnating the substrate with an electrically isolating material, treating a side of the impregnated substrate so as to provide areas with different properties as to water or solvent resistance, washing the impregnating substrate with water or solvent so as to wash away the areas with relatively low water or solvent resistance for obtaining a prepared substrate with discrete areas, placing the prepared substrate in a metal deposition math, and depositing metal in the discrete areas in the presence of abrasive particles so as to form abrasive metal deposits.

7 Claims, 4 Drawing Sheets

METHOD OF FORMING A HIGH PRECISION FLEXIBLE ABRASIVE MEMBER

The invention is related to the field of forming flexible abrasive members. Such members, which may take the form of circular pads for grinding discs, or of loop shaped bands, are generally manufactured by depositing metal on a substrate, in the presence of abrasive particles. These abrasive particles become embedded in the metal deposits, and provide the abrasive action of the abrasive member.

The metal deposits, which support the abrasive particles, are usually adhered to a substrate in order to provide a strong bond. This bond should be strong enough to withstand the high wear and tear which occurs during grinding.

From the state of the art, several methods are known for manufacturing such abrasive members. According to GB-A-1375571, a sheet is embedded in a backing material, leaving only isolated areas exposed on one side of the sheet. Subsequently, a metal together with embedded abrasive particles is deposited on these isolated areas by means of a plating process.

This prior art method has the disadvantage that, due to the fact that the isolated areas are only on one side of the sheet, the process of depositing the metal is rather slow. The isolated areas should be activated by a metal activation bath, then be cleaned in a separate cleaning bath and be plated by electroplating. Apart from the slow progress of this method, it is environmentally unfriendly having regard to the chemicals used in the activating and cleaning baths. Furthermore, the quality of the adhesion between metal deposits and the sheet is relatively poor.

GB-A-1534448 teaches a method for manufacturing an abrasive member by masking off a backing sheet with a mask such as a perforated tape, plastic, paint, photoresist rubber or the like, and by subsequently depositing a metal with abrasive particles on isolated exposed portions of the backing sheet.

Also from EP-B-263785 a method of this kind is known. Both prior art methods suffer from the problem that the metal deposits cannot be formed within a well defined boundary, in case the mask is applied on one side of a porous substrate. In those cases, the non covered side of the substrate will be plated together with the isolated, exposed areas on the other side. This results in a long production time, and also in a less flexible product.

The object of the invention is to provide a method for manufacturing a precision flexible abrasive member which is both cheap and quick, and which provides a better adherence of the metal deposits onto the substrate. This object is achieved by a method of manufacturing a flexible abrasive member, comprising the steps of:

- providing a porous substrate,
- impregnating the substrate with an electrically isolating material,
- treating a side of the impregnated substrate so as to provide areas with different properties as to water or solvent resistance,
- washing the impregnated substrate with water or a solvent so as to wash away the areas with a relatively low water or solvent resistance for obtaining a prepared substrate with discrete areas,
- placing the prepared substrate in a metal deposition bath, and
- depositing metal in said discrete areas in the presence of abrasive particles so as to form abrasive metal deposits.

By impregnating the substrate, it is fully and reliably covered on both sides. This means that only in discrete areas from which subsequently the impregnating material is removed, the porous substrate is accessible. The rest of the substrate is fully inaccessible, which ensures that metal deposition only takes place in very well defined, discrete areas.

As before, it is still possible to create open, discrete areas only on one side of the substrate. However, for obtaining a good adherence, it is preferred to create open areas on both sides of the substrate. In case the discrete areas thus obtained on both sides of the substrate are congruent, the substrate is embedded fully in the metal deposits, thus providing a strong bond.

Alternatively, it is possible to treat the other side of the substrate fully. In that case, said side is completely covered by the electrically isolating material.

The treatment referred to before, by means of which discrete areas are obtained, can take several forms. Preferably, said treatment comprises the steps of:

- impregnating the substrate with a resin, and
- exposing the discrete areas to UV-light so as to render them water or solvent resistant for forming a prepared substrate.

The discrete areas may be defined by the openings of a film placed between a source of UV-light and the side in question of the substrate.

The step of impregnating the substrate may be carried out in several ways as well. According to a first possibility, the substrate is impregnated by dip coating. Separate pieces of substrate material are dipped in a container comprising a fluid coating material. After removing and drying the coating, the substrate can be processed further. This method is in particular suitable for small batches.

Preferably, the porous substrate is electrically conductive, and the metal deposits are electro-formed.

Figure 1:
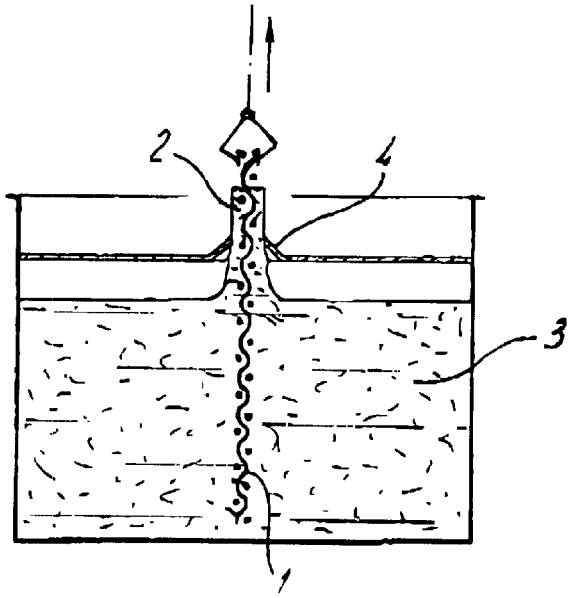
FIG. 1 shows a step of dipcoating a substrate.
Figure 2:
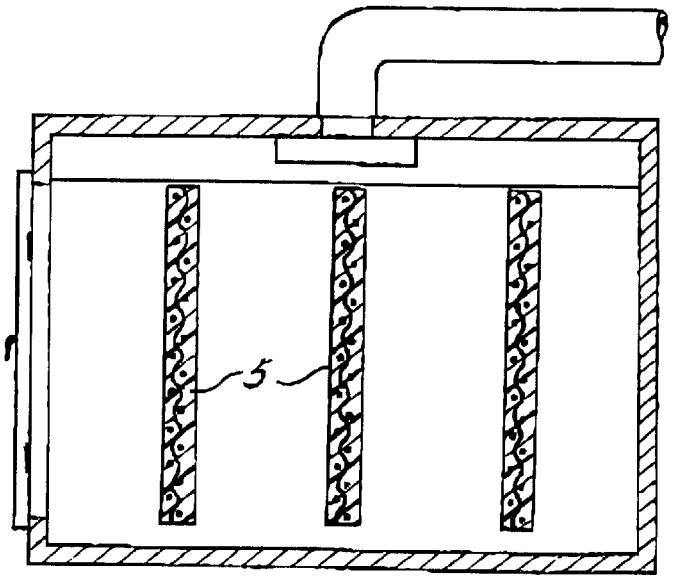
FIG. 2 shows the step of drying the impregnated substrates.

According to the method of FIG. 1, porous substrate 1 is dipcoated in a resin bath 3. The thickness and the precision of the thickness of the resin coating 2 is controlled by precision doctor blades or squeegees 4. The product 5 thus obtained, comprising the porous substrate 1 once filled with the precise and controlled amount of resin 2 is ovendried, as shown in FIG. 2.

Figure 3:
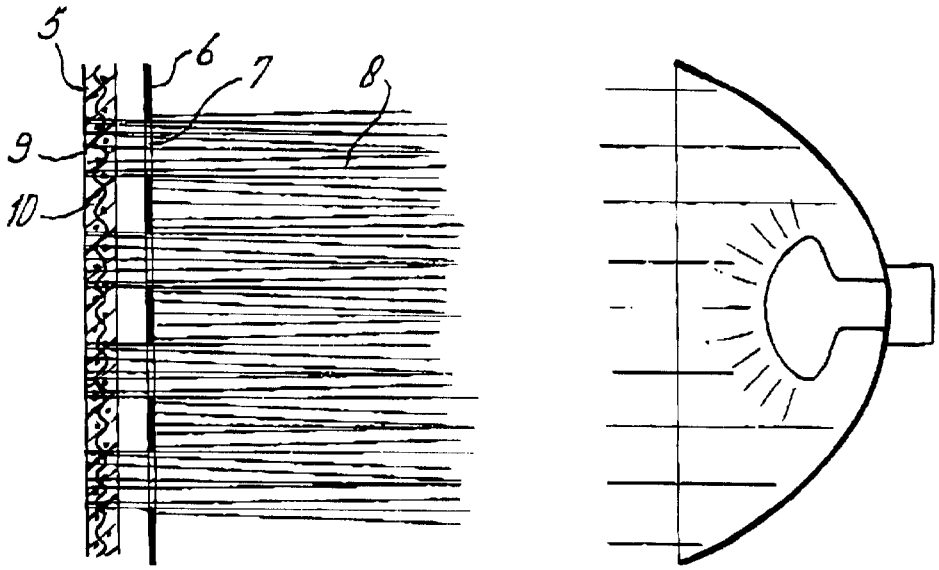
FIG. 3 shows the step of treating the substrate.
Figure 4:
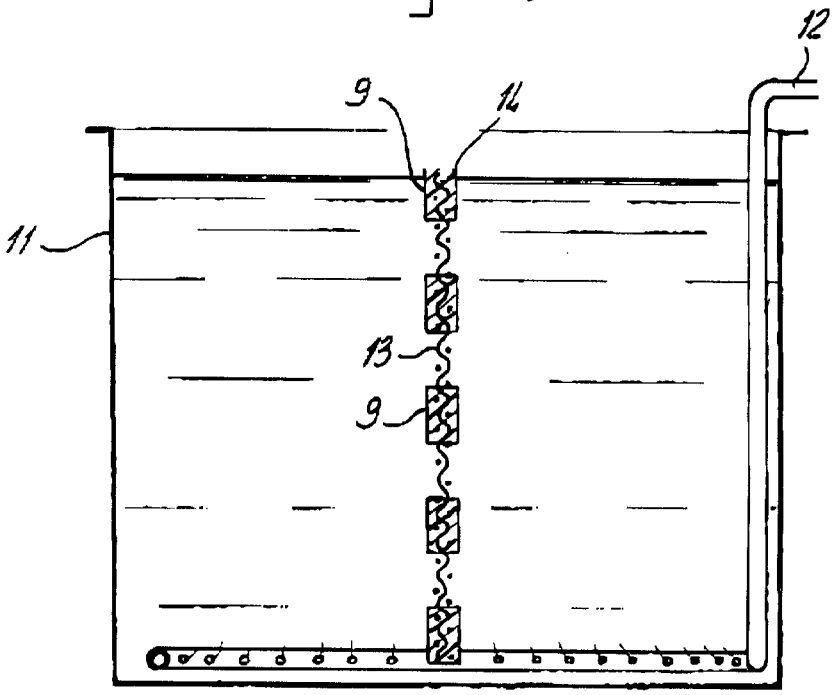
FIG. 4 shows the step of washing the substrate.

The next step is to expose discrete portions 9 of product 5 through a film 6 with a specific pattern 7, of the ovendried resin to UV-light 8 to render those exposed portions 9 water and solvent resistant: see FIG. 3. The non exposed areas 10 will not become water-resistant and will be washed away (FIG. 4) in a water stripping tank 11 which is moved by pressing air through a perforated tube 12 to accelerate the washing process. This method is working and is valid as long as very thin substrates are being used between 25 and 100 micron with at least 25% open areas. Thus, a prepared substrate 14 comprising open areas 13 is obtained.

Another aspect of the invention is to also be able to make an abrasive according to the invention on substrates which are thicker than 100 micron or less open than 25%. As explained before, any exposed parts of the substrate will plate independently from being masked or not as long as they are not fully covered by electrically isolating material as a resin for example. This means that in the case the porous substrate used is thicker than 100 micron or less open than 25%, the UV-light will not be able to fully penetrate the resin and to make it water and solvent resistant. The result would be that the resin would be washed away at the backside of the substrate and this uncovered area would be filled with metal bond in the deposition process.

Figure 5:
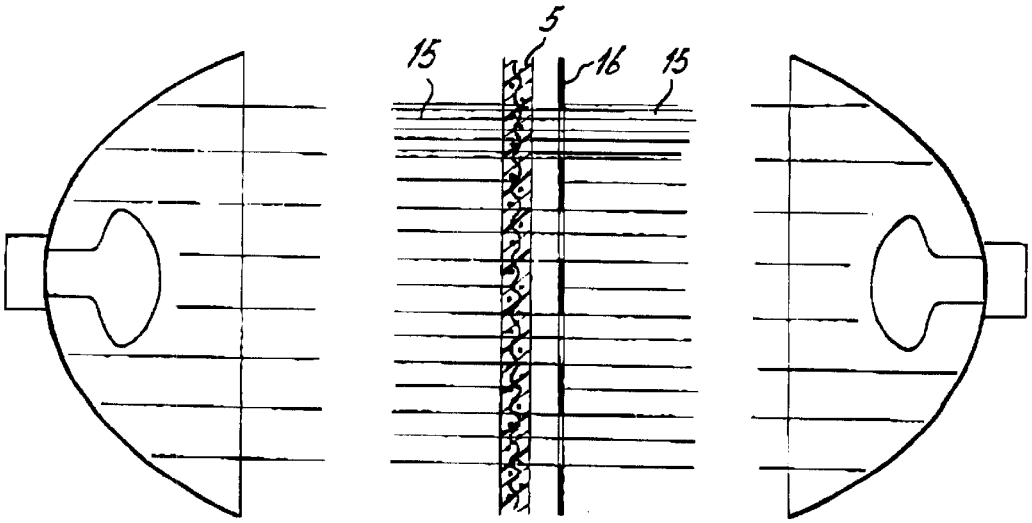
FIG. 5 shows the step of treating a substrate from both sides.
Figure 6:
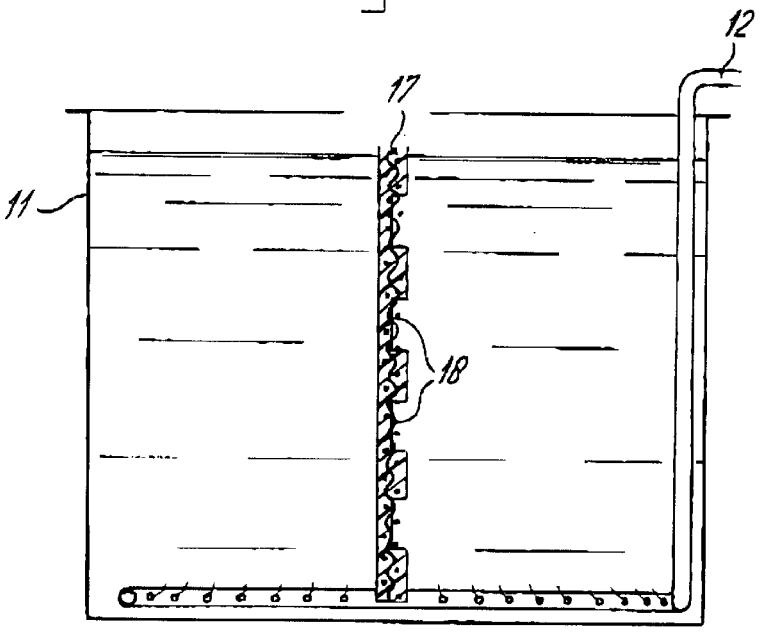
FIG. 6 shows a step of washing said substrate of FIG. 5.

To avoid this problem the fully in resin imbedded porous substrate 5 will be exposed (see FIG. 5) to UV-light 15 from both sides. On both sides a film 16 with the desired pattern can be applied but at least to one side. This substrate is than freed (FIG. 6) from the areas of not water-resistant resin in a water stripping tank and providing a prepared substrate 17 having open areas 18 on one side only.

Thanks to this process, a precision is achieved which was unknown in flexible super abrasive members using an open porous substrate. The size and quantities of the strands, parts or openings are not relevant anymore. The resin hardened with UV-light will stay exactly in the desired place with the desired thickness as wanted.

Figure 7:
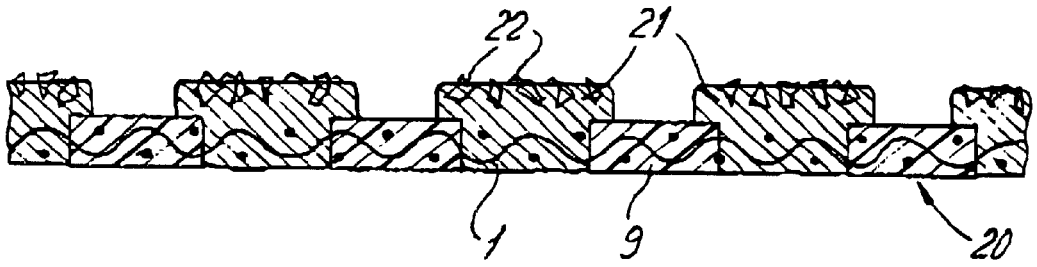
FIG. 7 shows a first flexible abrasive member.
Figure 8:
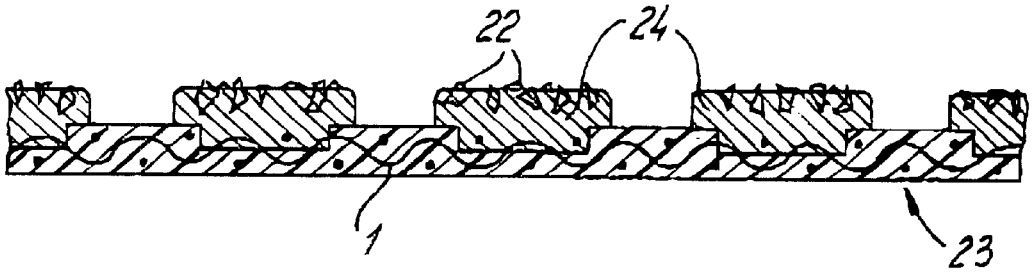
FIG. 8 shows a second flexible abrasive member.

Once the so prepared flexible porous substrate is dried, the metal bond is being electroformed within the discrete openings. An electroforming process has been elected instead of a classical electroplating technique used in the filled because it avoids the activating and cleaning process as mentioned in the state of the art. The metal bond is formed directly in an on the strands, parts and openings of the flexible, porous substrate in the presence of abrasive in an electrodeposition bath, As a result, an abrasive member 20 or 23 is obtained with metal deposits 21 respectively 24, carrying abrasive particles 22. The abrasive member 20 with throughgoing deposits 21 of FIG. 7 is obtained by carrying out the deposition process on the prepared substrate 14 according to FIG. 4. The abrasive member 23 of FIG. 8 is obtained by carrying out the deposition process on the prepared substrate 17 according to FIG. 6.

Even though the here described method is quite expensive when applied with small quantities the cost of manufacturing is unbeaten when a mass production process is applied.

What is claimed is:

1. Method of manufacturing a flexible abrasive member, comprising the steps of:

providing a porous substrate;

impregnating the substrate with an electrically isolating material;

treating a side of the impregnated substrate so as to provide areas with different properties as to water or solvent resistance;

washing the impregnated substrate with water or a solvent so as to wash away the areas with a relatively low water or solvent resistance for obtaining a prepared substance with discrete areas, said discrete areas being said areas having the electrically isolating material removed;

placing the prepared substrate in a metal deposition bath; and depositing metal in said discrete areas in the presence of abrasive particles so as to form abrasive metal deposits.

2. Method according to claim 1, wherein both sides of the substrate are treated.

3. Method according to claim 2, wherein the discrete areas of both sides are congruent.

4. Method according to claim 1, wherein the other side of the substrate is fully treated.

5. Method according to claim 1, comprising, the steps of:

impregnating the substrate with a resin, and exposing the discrete areas to UV-light so as to render them water or solvent resistant for forming a prepared substrate.

6. Method according to claim 5, wherein the discrete areas are defined by the openings of a film placed between a source of UV-light and the side of the substrate.

7. Method according to claim 1, wherein the substrate is impregnated by dip coating.

* * * * *